US008490351B1

(12) United States Patent
Scott

(10) Patent No.: US 8,490,351 B1
(45) Date of Patent: Jul. 23, 2013

(54) PIPE FLASHING PROTECTOR

(71) Applicant: Nathan Scott, Loudon, TN (US)

(72) Inventor: Nathan Scott, Loudon, TN (US)

( * ) Notice: Subject to any disclaimer, the term of this patent is extended or adjusted under 35 U.S.C. 154(b) by 0 days.

(21) Appl. No.: 13/631,384

(22) Filed: Sep. 28, 2012

Related U.S. Application Data

(60) Provisional application No. 61/598,310, filed on Feb. 13, 2012.

(51) Int. Cl.
*E04D 13/143* (2006.01)
*E04D 13/147* (2006.01)

(52) U.S. Cl.
USPC ..... 52/219; 52/58; 52/741.3; 52/741.4; 285/42; 454/1; 454/47

(58) Field of Classification Search
USPC ..... 52/199, 218, 219, 220.8; 285/42–44, 285/332.1, 334.1; 454/1, 3, 41, 47
See application file for complete search history.

(56) References Cited

U.S. PATENT DOCUMENTS

| | | | | | |
|---|---|---|---|---|---|
| 506,930 | A | * | 10/1893 | Nies et al. | 285/43 |
| 3,313,559 | A | | 4/1967 | Kifer | |
| 4,261,598 | A | * | 4/1981 | Cornwall | 285/56 |
| 4,437,687 | A | * | 3/1984 | Wilson | 285/42 |
| 4,882,886 | A | * | 11/1989 | Harbeke | 52/232 |
| 5,211,428 | A | | 5/1993 | Emerson | |
| 6,279,272 | B1 | | 8/2001 | Nill | |
| D606,186 | S | | 12/2009 | Routh | |
| 2005/0150176 | A1 | | 7/2005 | Erekson | |

* cited by examiner

*Primary Examiner* — Robert Canfield
(74) *Attorney, Agent, or Firm* — ZIP Law PLLC; Claire Zopf

(57) ABSTRACT

A pipe flashing protector for protecting the vulnerable joint between a vent pipe and the roof flashing for a building, house or other architectural structure to prevent wear and decay of the joint and more specifically to protect the joint from ultra-violet light, moisture, and debris.

14 Claims, 11 Drawing Sheets

PIPE FLASHING PROTECTOR

FIELD OF THE INVENTION

The present invention relates to protecting the vulnerable joint between a vent pipe and the roof flashing for a building, house or other architectural structure to prevent wear and decay of the joint and more specifically to protect the joint from ultraviolet light, moisture, and debris.

BACKGROUND OF THE INVENTION

Building roofing in general deals with first sealing a structure from moisture and debris and second protecting the sealing material from damage caused by moisture and debris. Typical roofs have a vent pipe to permit the escape of gas-phase materials, such as for dryers, bathroom fans, or other fixtures with the connection being achieved by extending a pipe through the roof so that it opens outside of the structure. Roof flashing is placed around the outside of the pipe where it passes through the roof to prevent rainwater, other precipitation, or debris from entering the building. However, this flashing which is typically elastomeric or caulking material tends to become brittle, crack, peel or rot away because of exposure to the sun, moisture, debris, and other elements. There have been several variations and improvements to roof flashings; however these variations and improvements tend to not protect the flashing seal from all possible elements that may cause it to decay overtime or be damaged.

What is needed is a device that reinforces and protects the joint against debris, blocks ultraviolet light thereby reducing decay, and seals the joint from moisture.

OBJECT AND SUMMARY OF THE INVENTION

It is an object of a first embodiment of the invention to protect the joint seal between a vent pipe and roof flashing from moisture, debris, and other elements, therefore increasing the longevity of the seal by providing a simple, inexpensive, long lasting pipe flashing protector apparatus and method to prevent damage to the joint seal or to repair and prolong the life of the seal without replacement of the roof flashing. The pipe flashing protector of the present invention encloses the joint seal by covering and containing the seal within a protector and applying a bead of caulk to the internal shelf of the pipe flashing protector and the top of the vent piping to create a seal that will protect the joint from the elements. A separate vent pipe continues out of an opening in the top of the pipe flashing protector and is sealed by a caulk or elastomeric adhesive compound to the flashing protector apparatus to produce an outer seal to protect the joint in all directions. The protector apparatus may also be caulked at its base to adhere the protector to the roof flashing or other roof covering. In a further embodiment the pipe flashing protector, may be threaded to receive a threaded vent pipe and flashing pipe to create a seal, thereby increasing the longevity of the seal.

An object of the present invention is to provide an effective sealing apparatus that may be used to cover damaged roof flashing and a leaking joint seal of a vent pipe. Installation of the protector does not require reroofing a section of the roof, replacing the flashing or replacing the pipe when the joint seal is damaged. Instead the pipe flashing protector may be installed on top of the roof flashing and be secured to the vent pipe to repair a leaking joint seal.

Another object is to install a pipe flashing protector apparatus on new building construction to protect and secure the joint seal of a vent pipe.

Another object of the invention is to easily replace the pipe flashing protector if damaged without reroofing of shingles or the roof flashing.

Another object of the invention is to provide repair if the vent pipe extending out of the pipe flashing protector is damaged. The repair requires no cutting and welding to join an extension onto the vent pipe, or the removal or replacement of the entire pipe and roof flashing. The damaged pipe can be cut below any damage and be connected to the pipe flashing protector. A new pipe can be connected to the upper surface of the pipe flashing protector in a very efficient and cost effective process, removing the need for unnecessary reconstruction.

A further object of the invention is the connection of an upper and lower vent pipe to the pipe flashing protector using an adhesive compound.

A further object of the invention is to uses a threaded receiver on the pipe flashing protector to receive and connect a threaded upper vent pipe and a threaded lower vent pipe.

A still further object is to create a versatile pipe flashing protector that can work on many different styles of roof flashings, and a variety of standard and non-standard pipes and piping fixtures.

A still further object is to create a pipe flashing protector that can be aesthetic to the building design, by having the ability to coat or color the pipe flashing protector to match roofing materials and the design of the building.

These and other features, advantages and improvements according to this invention will be better understood by reference to the following detailed description and accompanying drawings.

BRIEF DESCRIPTION OF THE DRAWINGS

Several embodiments of the present invention will now be described by way of example only, with reference to the accompanying drawings in which.

DETAILED DESCRIPTION OF THE DRAWINGS

Figure 1:
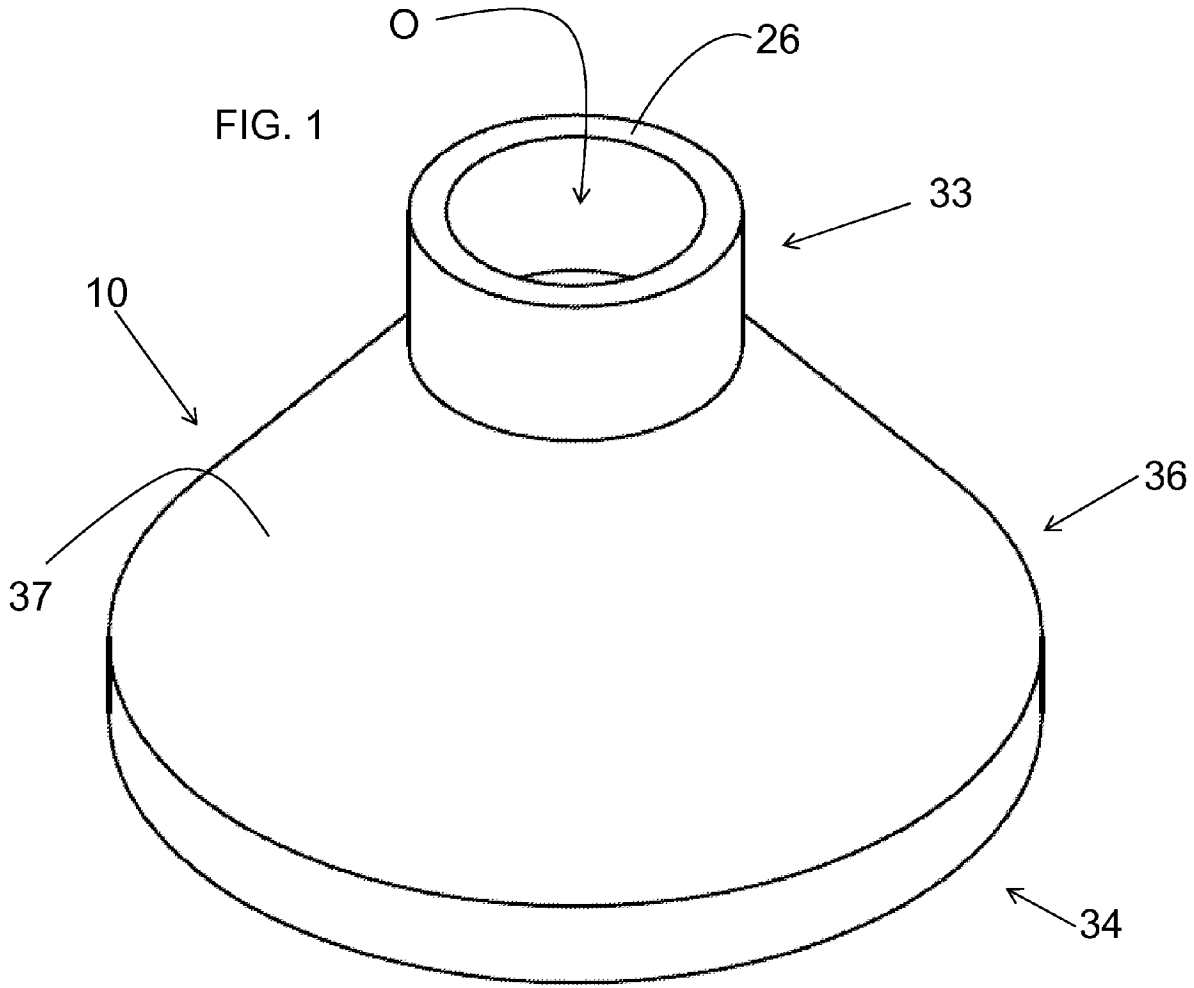
FIG. 1 is an isometric view of a first embodiment of the pipe flashing protector.

Referring now to FIG. 1, a pipe flashing protector 10 is shown. The pipe flashing protector has a base 34 merging with a sloped portion 36 that has a tubular portion 33 extending through the sloped portion. The sloped surface 37 of the conic portion 36 is designed to force water and debris to roll off and away from the pipe flashing protector 10. In this first embodiment, the pipe flashing protector 10 is formed in a substantially conic shape in order to extend around and cover the joint between a vent pipe and roof flashing on a building structure. Other designs and relative dimensions of each of the components are contemplated within the scope of the present invention. The tubular portion 33 has an opening O to allow for the ventilation of exhaust gases from the interior of the building. In a first embodiment, the pipe flashing protector 10 may be constructed from cross-linked polyethylene (PEX), cross-linked high density polyethylene (HDPE), Polyvinyl Chloride (PVC), or other weather and UV resistant metals, plastic or ceramic compounds.

Figure 2:
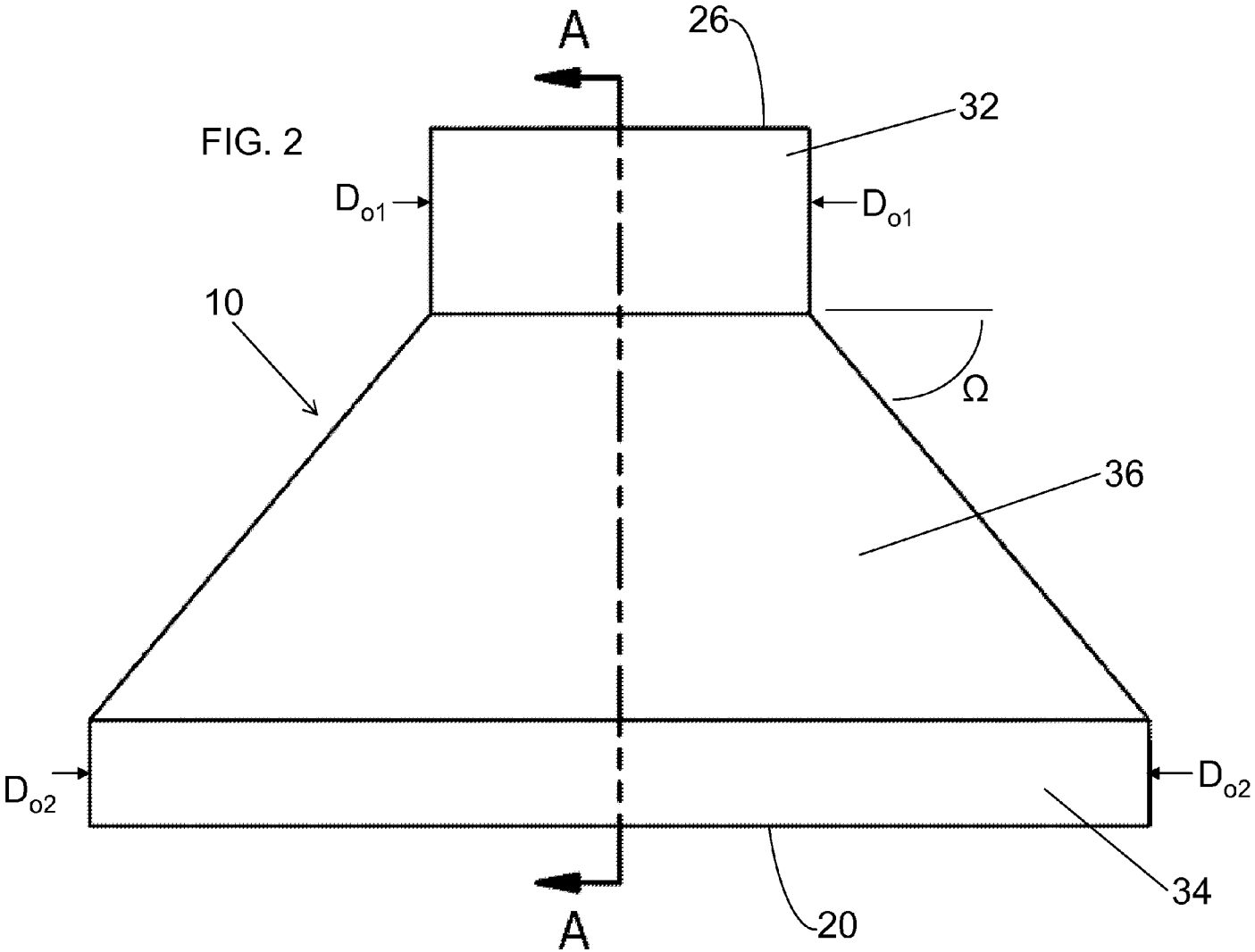
FIG. 2 is an elevation view of the first embodiment of the pipe flashing protector.

FIG. 2 shows an elevation view of the pipe flashing protector 10. The tubular portion 33 has an upper tubular portion 32 and an internal housing extension portion 42. The upper tubular portion 32 has an outside diameter $D_{o1}$ that is smaller than the outside diameter $D_{o2}$, of the base 34. This difference in diameters creates the angle Ω that the middle section portion 36 is sloped at. In further embodiments the angle Ω can be at any angle greater than 90 degrees to allow rain and moisture to roll off and away from the upper tubular portion 32 of the pipe flashing protector 10. The intersection between the upper tubular portion 32 and the sloped middle portion 36 may have a sharp intersection as shown in the first embodiment, or can have a smooth or rounded intersection to again reduce the collection of debris on the pipe flashing protector 10. The intersection between the base 34 and the middle portion 36 may also have a sharp intersection as shown in the first FIG. 2, but may be rounded as well.

Figure 3:
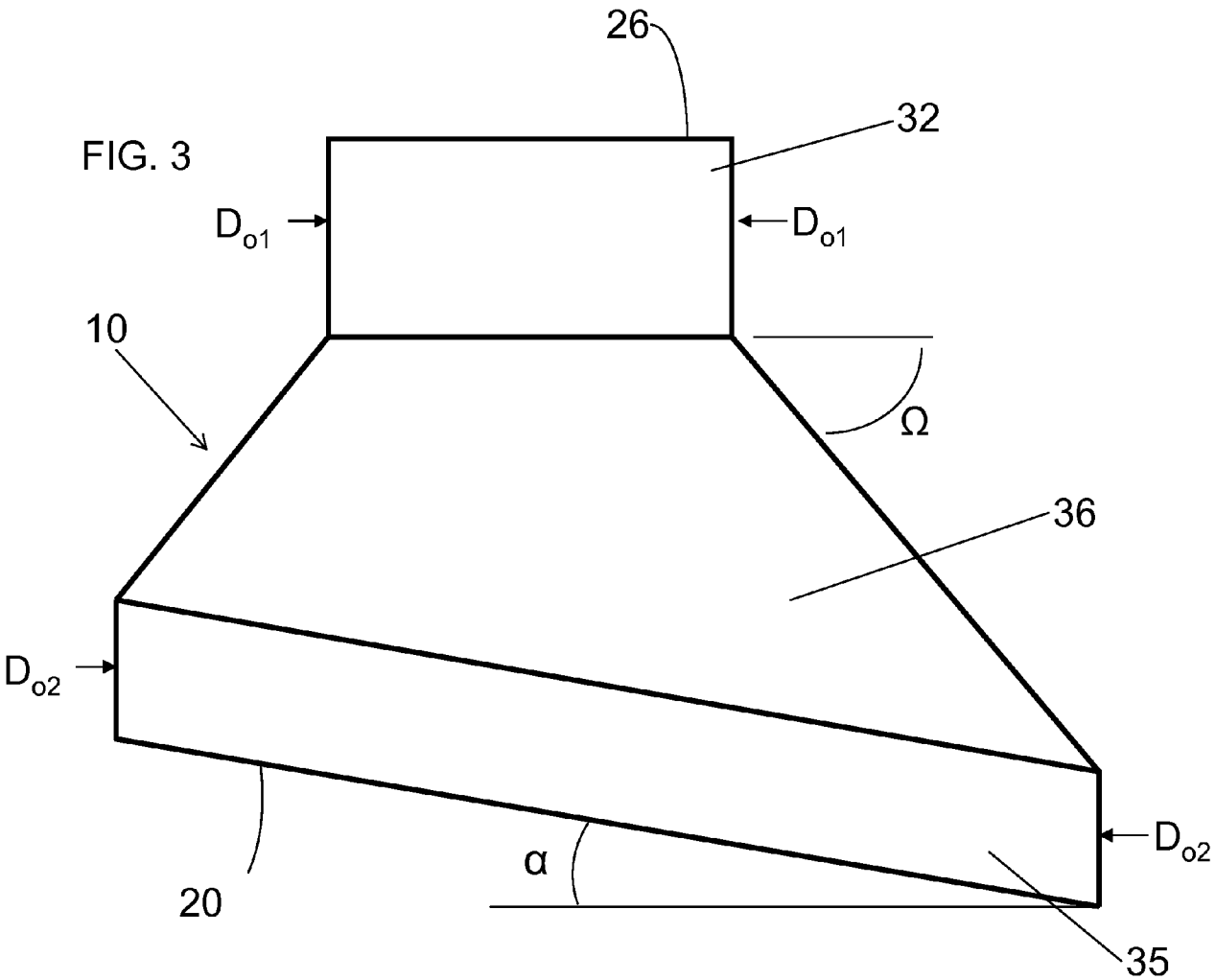
FIG. 3 is an elevation view of a further embodiment of the pipe flashing protector.

In a first embodiment, the top surface 26 of the pipe flashing protector 10 is shown as substantially parallel to the bottom surface 20 of the base 34. In further embodiments as shown in FIG. 3, the bottom surface 20 and base 35 may be angled to accommodate the slope of a roof, the roof flashing 14 or the surface contours of shingles or other roof coverings. In this embodiment, the base 35 extends at an angle α that is at the same slope or pitch of the roof and in this way the bottom surface 20 of the pipe flashing protector 10 substantially contacts and may be sealed to the surface area of the roofing material 16.

Figure 4:
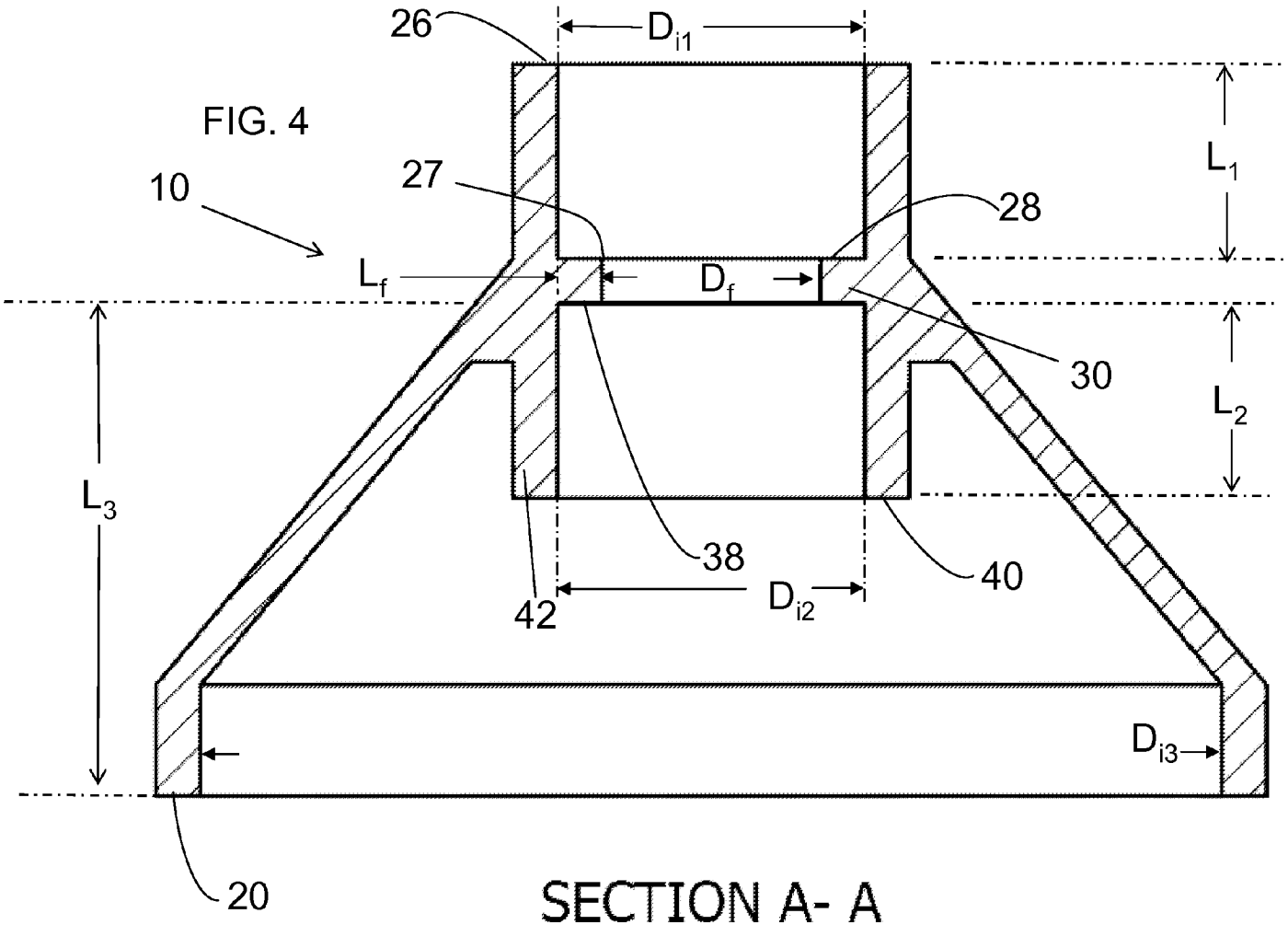
FIG. 4 is a cross-section view of the first embodiment of the pipe flashing protector along line A-A.
Figure 5:
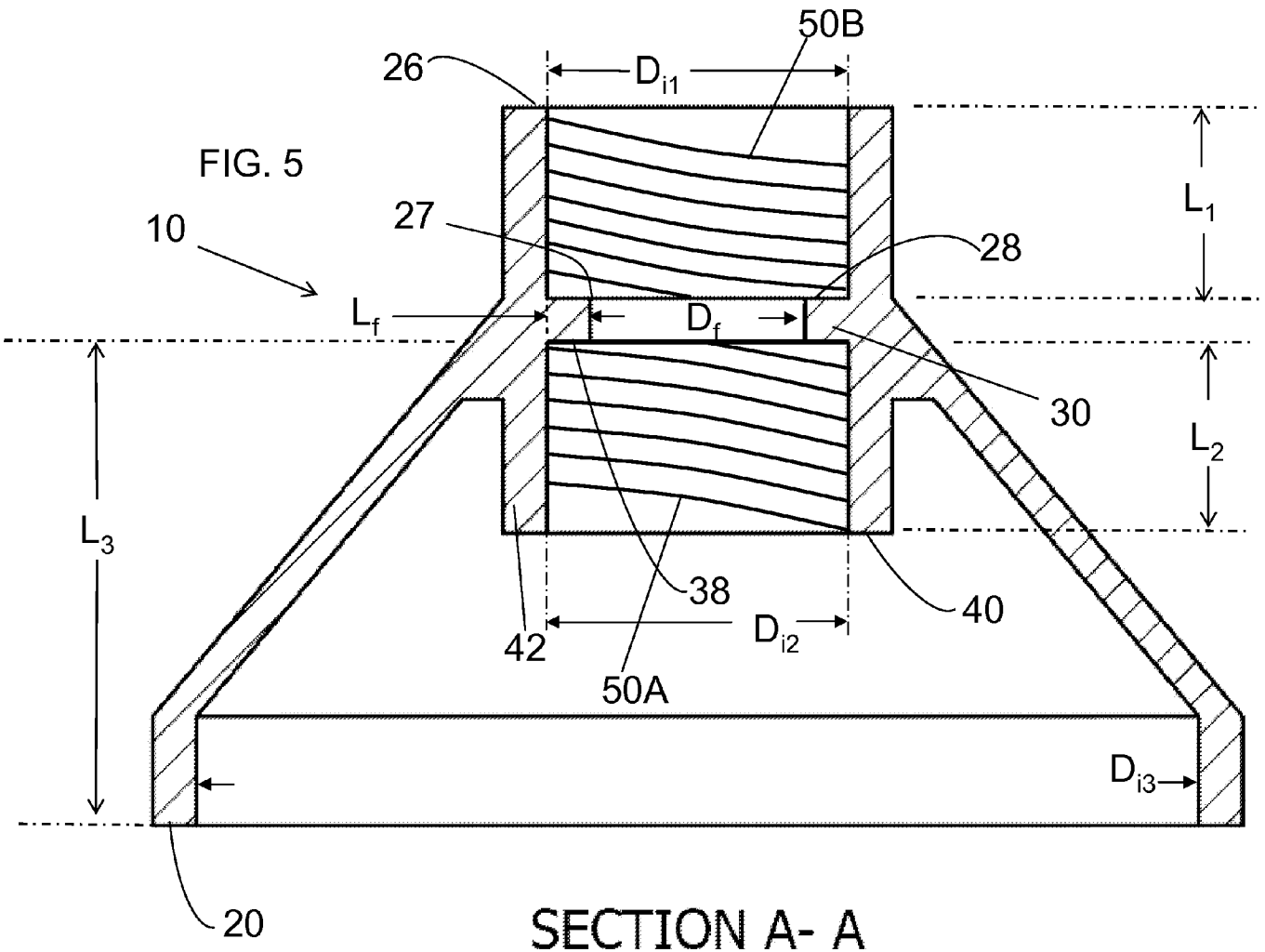
FIG. 5 is a cross-section view of a further embodiment of the pipe flashing protector along line A-A having threaded connectors.

Illustrated in FIG. 4 is a cross-section of the first embodiment of the pipe flashing protector 10. The cross-section is cut along axis line A-A of FIG. 2. Internally, the pipe flashing protector 10 includes a flange 30 that provides a sealing surface for the attachment of the upper and lower vent pipes. A first length $L_1$ extends from the upper surface 28 of the flange 30 to the top surface 26 of the pipe flashing protector 10. The length $L_1$ may be of a distance of 1" to 6" or longer dependent upon the length of the upper vent pipe 12, with the length $L_1$ extended to accommodate and support larger and longer vent pipes. Extending from the bottom surface 38 of the flange 30 is the vent pipe housing extension 42 that extends to a length $L_2$ to accommodate the internal, lower vent pipe 18. The length $L_2$ may be extended to a shortened length as compared to $L_1$ depending on the size of the internal vent pipe. A lengthened $L_2$ provides a surface area to form a frictional fit of the internal pipe to the pipe flashing protector 10. With a proper frictional fit and the force of gravity holding the pipe flashing protector 10 to the internal vent pipe 18 affixing the pipe to the protector 10 using caulk or an elastomeric adhesive compound may not be required. In further embodiments lengths $L_1$ or $L_2$ can have threaded sections 50A and 50B, as shown in FIG. 5, to form a seal with a threaded lower vent pipe 18 and a threaded upper vent pipe 12. The threaded sections 50A and 50B may on the interior or exterior surfaces of the upper tubular portion 32 or the housing extension 42 to accommodate internally or externally threaded vent pipes. A tapered thread or cylindrical thread with an O-ring can be used to create a gas tight seal. Lengths $L_1$ and $L_2$ can also have different thread patterns, or thread counts depending on the application. The length $L_3$ extends from the base surface 20 to the lower flange surface 38 and is the proper length for the extension of the lower internal vent pipe 18 to extend from the surface of a roof to the lower flange surface 38.

The housing extension 42 internal diameter $D_{i2}$ may be of any size to accommodate the internal vent pipe and may be larger or smaller than the internal diameter $D_{i1}$ of the upper tubular portion 32. The inside diameter $D_{i3}$ of the base 34 may be larger than either of the diameters of the upper tubular portion 32 or the housing extension 42 to provide structural support for the upper vent tube 12 that extend out and above the upper tubular portion 32. The flange 30 separates the internal diameter $D_{i2}$ of the housing extension 42 from the upper tubular portion with the internal diameter $D_f$ of the flange 30 being shorter in length than either the internal diameters $D_{i1}$ or $D_{i2}$.

The shortened diameter of the flange 30 forms a shelf having an upper surface 28 and a lower surface 38 that extends around the entire circumference of the flange 30. The length $L_f$ of the shelf of the flange 30 may be of any distance greater than the wall thickness of the upper and lower vent pipes to provide a support for the pipe to rest against. The lengthened shelf of the flange 30 extending further than the thickness of the pipes also provides adequate surface area for applying caulk or adhesive compound to create a secure seal between the upper and lower pipes 12, 18 and protector 10 to keep moisture, debris, and ultraviolet light away from the protected area. The edge portion 27 may be formed as a right angle as shown in FIG. 4 or may be curved or of a rounded shape.

The length $L_f$ of the shelf of the flange 30 may be in a range of 0.25" to 1.5" to extend beyond the wall thickness of most vent pipes that are specified by local government code requirements. With the extension of the shelf length $L_f$ the diameter $D_f$ at the flange point is shortened and therefore the shelf length $L_f$ is limited to provide an acceptable diameter $D_f$ for adequate air flow based on these local code requirements. Diameter $D_f$ needs to be sized in regards to the local code requirement for vent piping so that the shelf length $L_f$ does not create an overhang into the area that exhaust gases will be exiting through thus restricting air flow, but also not small enough to not give enough surface area on the shelf of the flange 30 for the pipes to connected and sealed to. An inadequate shelf length $L_f$ will make the seals between the pipes and pipe flashing protector 10 unstable and could cause any of the components to break due to wind or other elements. The diameters $D_{i1}$ and $D_{i2}$ as well should be no less than the diameters specified in the local code requirements for vent piping which on average has an outside diameter of between 2" and 2.5". In a first embodiment, the length may more particularly be in a range from 0.375" to 0.75" with a diameter $D_f$ in a range of between 2" and 2.5".

The lower base portion diameter $D_{i3}$ is also large enough to not restrict the flow of gases and to also properly support the extended upper pipe 12 attached to the protector 10. The surface area 20 of the base of the protector is of an adequate thickness to properly support the protector 10 and to properly interact with the roof flashing, shingles, or other roof covering without creating gaps or openings between the roof covering 16 and pipe flashing protector 10. Adequate contact between the roof covering 16 and protector 10 prevents debris and moisture from reaching the seal. In the first embodiment the thickness of the extension 42 is the same as the flange 30 and the thickness of the upper portion 36.

FIG. 5 shows the middle portion 36 and the top surface 26 of the tubular upper portion 32. The internal diameter $D_{i81}$ and outer diameter $D_{o1}$ of the tubular upper portion 32 is shown. The wall thickness of the upper tubular portion 32 is the difference between these two diameters and the thickness $T_u$ may be in the range of 0.125" to 1.25" and more particularly in a range of 0.5" to 1". The outer diameter $D_{o2}$ of the base 34 is shown which is larger than the outer diameter Do1 of the upper tubular to provide structural support for the upper vent pipe 12 that extends above the pipe flashing protector 10. The flange diameter $D_f$ is also shown as a smaller diameter than the upper tubular opening O. The upper surface 28 of the flange creates a shelf for the upper vent pipe 12 to be supported on. In a first embodiment as shown the thickness $T_u$ of the upper portion 32 and the flange surface 28 are substantially of the same thickness, although in other embodiments the upper thickness $T_u$ and the shelf of the flange 30 may be significantly different with the shelf being of a greater thickness that the pipe wall thickness $T_u$. The middle portion 36 has a smooth sloped surface 37 to allow moisture and debris to easily bead and roll off the pipe flashing protector 10.

Figure 6:
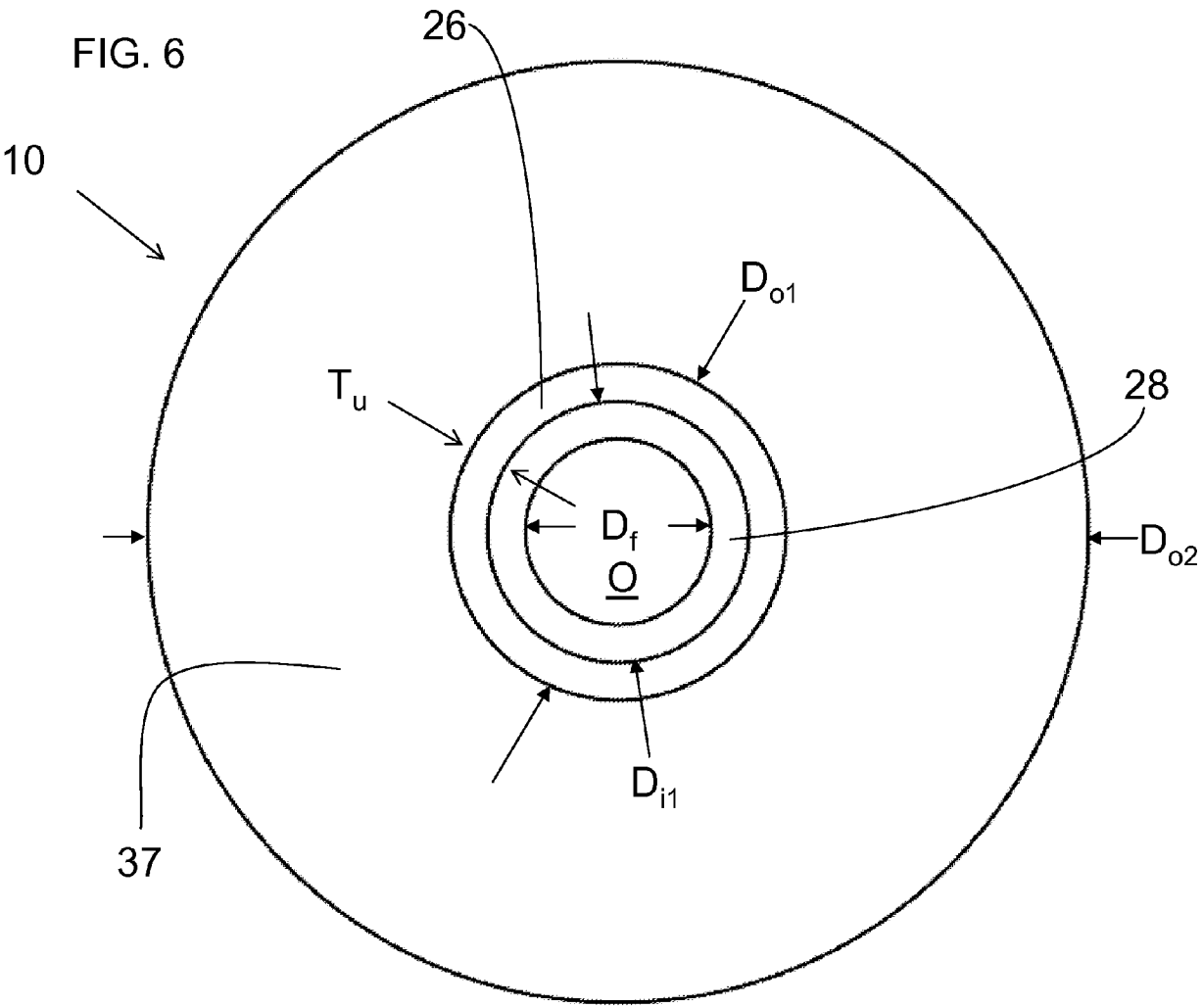
FIG. 6 is a top view of the first embodiment of the pipe flashing protector.

The bottom surface 20 of the pipe flashing protector 10 and the bottom surface 38 of the flange 30 are shown in FIG. 6 as a circular construction. Other shapes to accommodate different shapes of pipe are contemplated within the scope of the invention. The inside diameter $D_{i3}$ of the base 34 and outside diameters $D_{o2}$ of the base 34 are shown creating the thickness $T_b$ of the bottom surface 20 of the pipe flashing protector 10, which may be in a range of 0.125" to 1.5" and more particularly in a range of 0.5" to 1, depending on the support requirements for the upper vent pipe. The bottom surface 40 of the housing extension 42 as shown in a first embodiment is the same thickness as the base thickness $T_b$ but may be of any adequate thickness to guide the lower internal vent pipe 18. The lower flange surface 38 as described may be formed with any adequate length to provide a sealing surface for the lower vent pipe 18.

Figure 7:
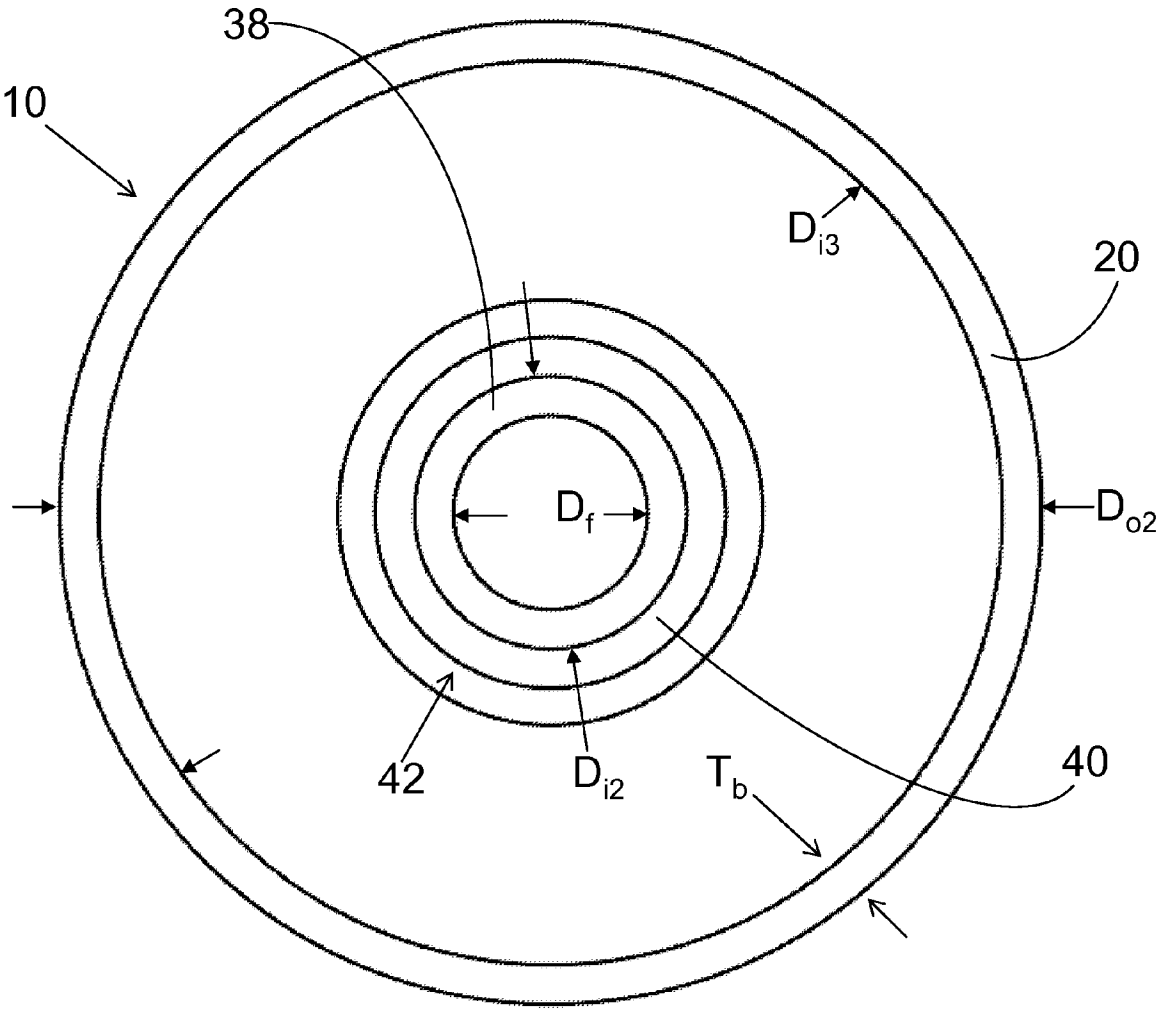
FIG. 7 is a bottom view of the first embodiment of the pipe flashing protector.

Referring to FIG. 7, the pipe flashing protector 10 is shown with an upper vent pipe 12 and a lower vent pipe 18 extending from within the building structure (not shown). The lower vent pipe 18 is surrounded with roof flashing 14 that rests on a shingle 16 or other roof covering. The pipe flashing protector 10 may be used in new construction or in the repair of roof flashing 14 that has decayed and does not properly seal, or in cases where the vent pipe 18 may have been damaged. For repair the vent pipe 18 may be cut to the length $L_3$ so that the pipe 18 may extend from the base 34 of the protector 10 to the lower flange surface 38 as shown in FIG. 4. The piece of pipe cut from the lower piece 18 may be used as the upper vent pipe 12. For new construction two separate pieces of pipe may be used.

Figure 8:
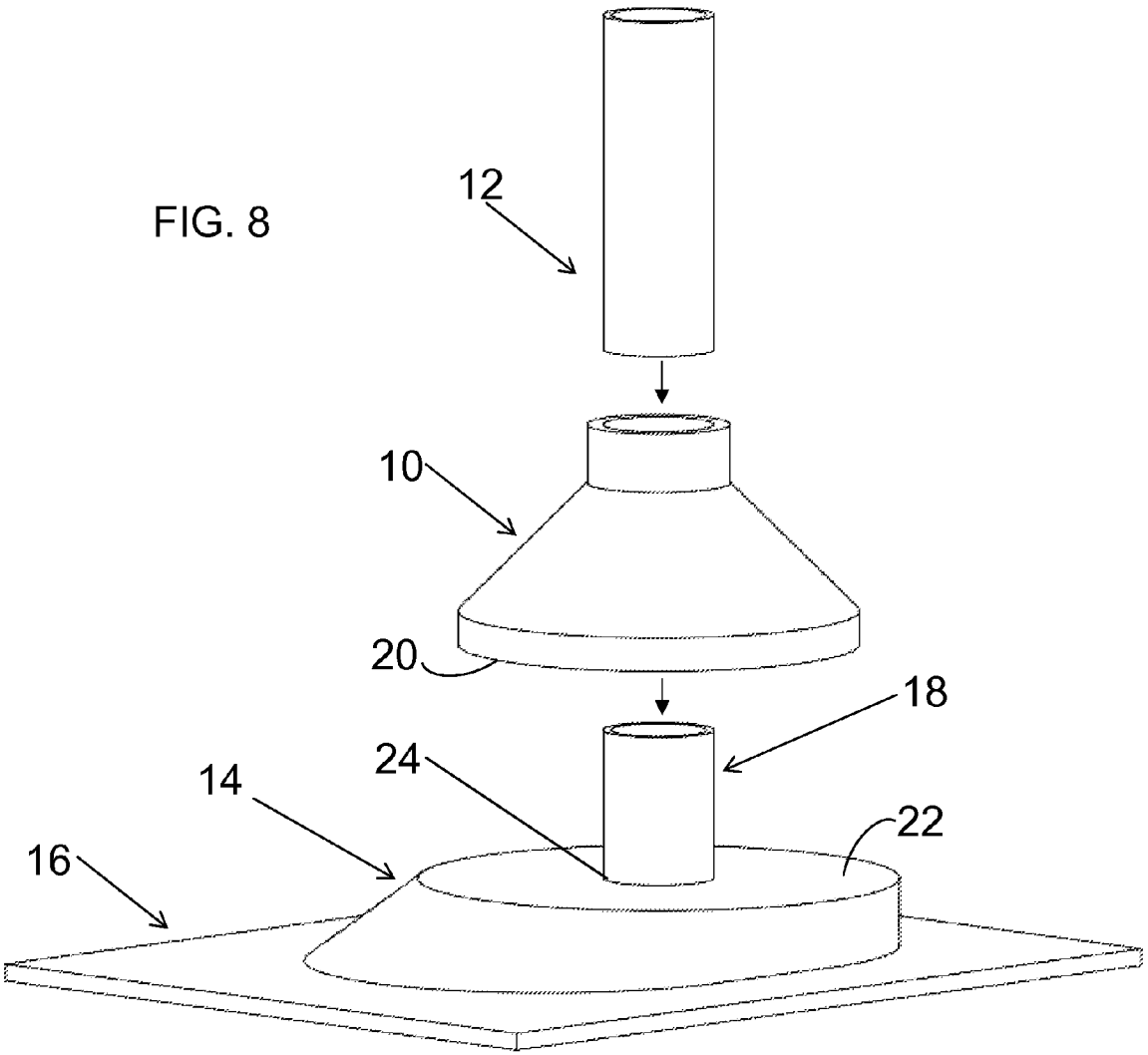
FIG. 8 is an exploded isometric view of the first embodiment of the pipe flashing protector with an upper and lower vent pipe.

To install the pipe flashing protector 10, the protector 10 is positioned over the internal vent pipe 18 that has been cut to the proper length and the upper pipe 12 is inserted into the upper tubular portion 32. In a first embodiment, the housing extension 42 of the pipe flashing protector 10 fits around the internal vent pipe 18 completely covering the joint 24 that is formed between the roof flashing 14 and the lower vent pipe 18. A snug frictional fit may be formed between the extension surface 42 and the pipe 18, however because the joint between the upper surface 45 of the pipe 18 and the flashing protector 10 is sealed, the pipe may have a smaller diameter than the internal diameter $D_{i2}$ of the extension 42. As shown in FIG. 8, if the length of the flange $L_f$ is of a greater length than the pipe thickness $T_p$ then enough of a sealing surface between the flange and pipe surface is provided even if a pipe diameter is substantially smaller than the internal diameter $D_{i2}$ of the extension 42. The upper vent pipe 12 is inserted into the upper tubular portion 32 of the protector 10.

Figure 9:
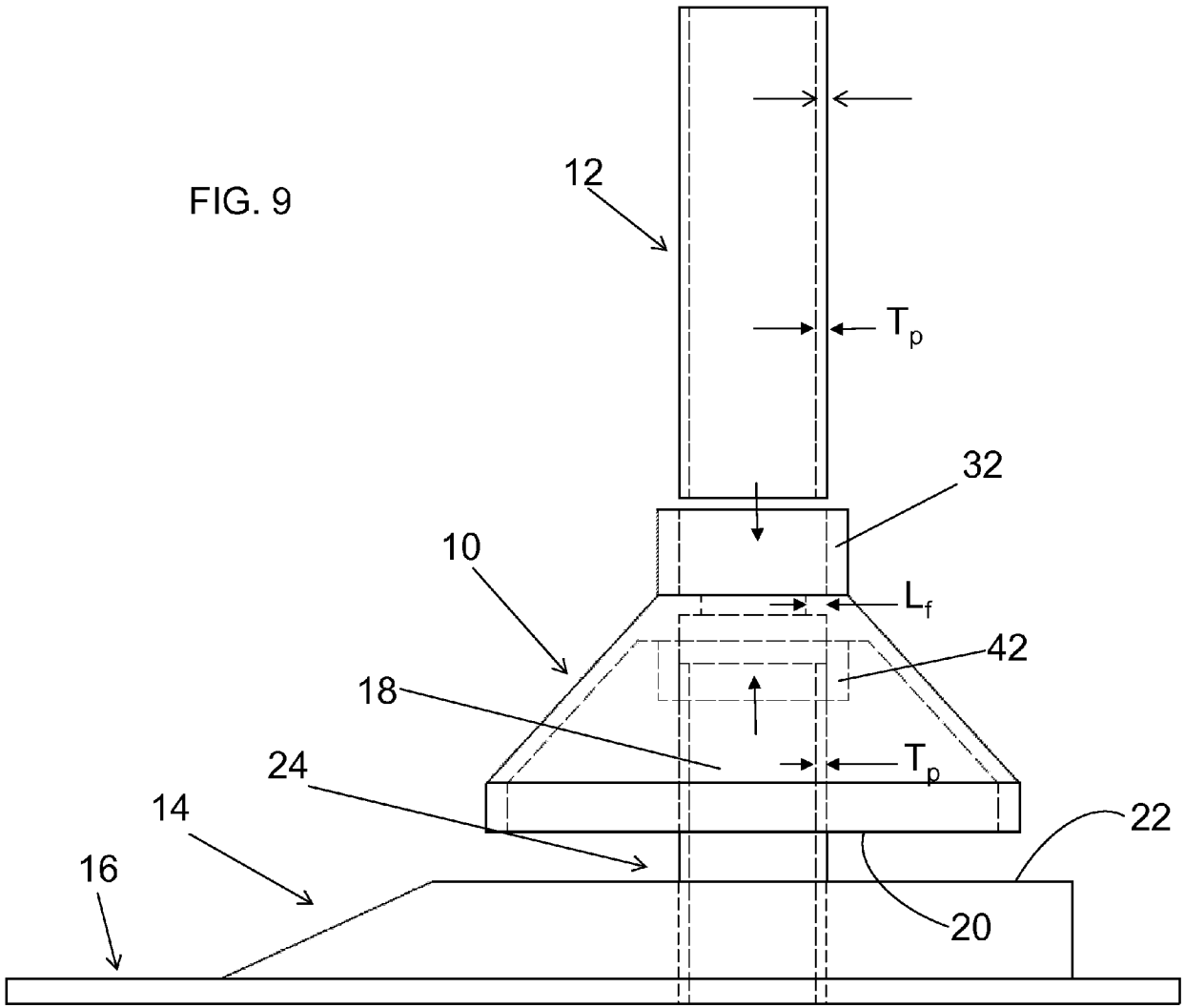
FIG. 9 is an elevation view of the first embodiment of the pipe flashing protector with an upper and lower vent pipe.

As shown in a cross-sectional view in FIG. 9, the upper surface 45 of the lower vent pipe 18 will mate with the lower surface 38 of the flange 30. The lower surface 44 of the upper vent pipe 12 will mate with the upper surface 28 of the flange 30. Caulk or adhesive compound may be applied to each surface to adhere each pipe to the pipe flashing protector 10 to create a water tight seal between these parts. Caulk or adhesive compound may also be applied to the base surface 20 to adhere the pipe flashing protector 10 to the roof flashing 14, the shingles 16 or other roof covering.

Figure 10:
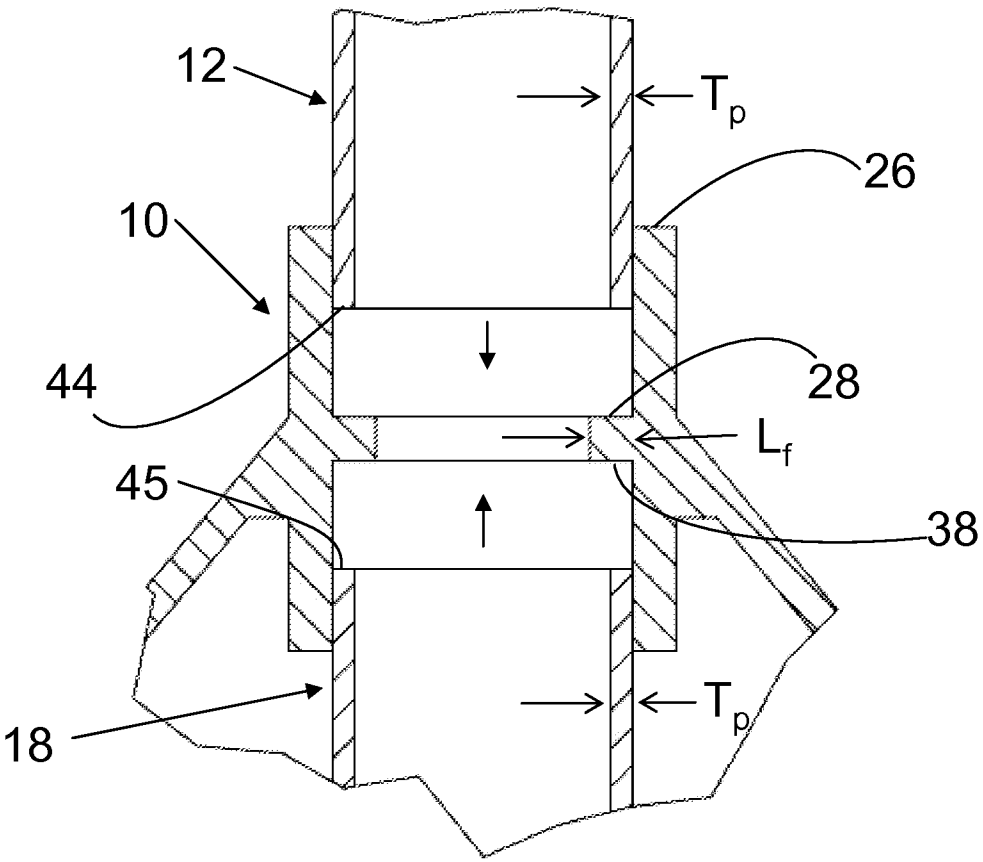
FIG. 10 is a detailed cross-section view of the flange area, of the first embodiment of the pipe flashing protector where the upper and lower vent pipe attach to the pipe flashing protector.
Figure 11:
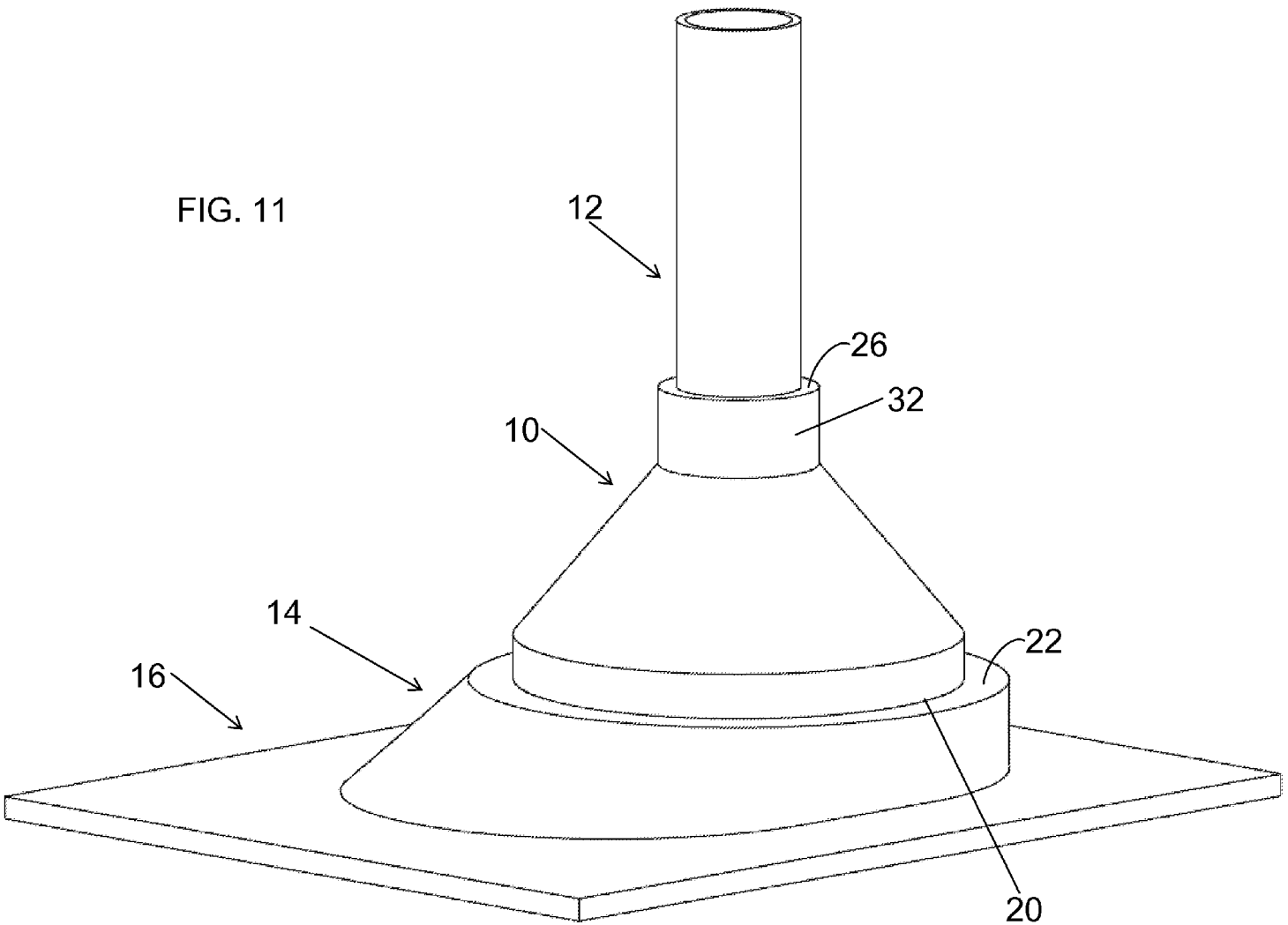
FIG. 11 is an isometric view of the first embodiment of the pipe flashing protector attached to the vent pipe.

In FIG. 10, the pipe flashing protector is shown as installed with the internal lower pipe 18 and joint 24 covered by the protector 10. The bottom surface 20 of the pipe flashing protector 10 is securely attached and sealed to the roof flashing 14 with no spaces or gaps between the protector 10 and the flashing 14. The vent pipe 12 also fits securely into the upper tubular portion 32 and extends up and out of the pipe flashing protector 10. Air flow from the building structure is directed through the internal vent pipe 18, through the protector flange 30, through the extension vent pipe 12 and out of the building. The pipe flashing protector 10 is used to protect the joint 24 around the internal vent pipe 18 from moisture, debris, and ultraviolet light.

In a further embodiment, the pipe flashing protector 10 and the vent pipe 18 is frictionally fit in the extension 42 and the pipe flashing protector 10 rests on the roof flashing 14 or other roof covering. Caulk or elastomeric adhesive compound is not applied to the lower surface 38 of the flange 30 or upper surface 45 of the pipe, but only to the upper surface 28 of the flange to seal the upper pipe 12 to the protector 10. Gravity holds the protector in place or adhesive compound may be used to affix the protector 10 to the roof flashing 14 or roof covering 16.

The invention has been described in detail with particular reference to certain preferred embodiments thereof, but it will be understood that variations and modifications can be effected within the spirit and scope of the invention.

What is claimed is:

1. A pipe flashing protector for protecting a joint between a vent pipe and roof flashing comprising:

a circular base portion;

a sloped conic portion extending up from the circular base portion;

a tubular portion having a flange with an upper and lower shelf surface, the tubular portion extending through the sloped conic portion; and wherein a lower vent pipe is affixed to the lower shelf surface of the flange and an upper vent pipe is affixed to the upper shelf surface of the flange.

2. The pipe flashing protector for protecting the joint between the vent pipe and roof flashing of claim 1 wherein the sloped conic portion is of a large enough dimension to cover the joint protecting it from decay and debris.

3. The pipe flashing protector for protecting the joint between the vent pipe and roof flashing of claim 1 wherein the tubular portion further comprises a threaded connector for attachment of a threaded lower vent pipe and threaded upper vent pipe.

4. The pipe flashing protector for protecting the joint between the vent pipe and roof flashing of claim 1 wherein the circular base portion is angled to match the slope of a roof.

5. The pipe flashing protector for protecting the joint between the vent pipe and roof flashing of claim 1 wherein a vent pipe is cut to a length matching the length from the base surface to the lower shelf of the flange and the cut off portion of the vent pipe is inserted through tubular portion and affixed to the upper shelf surface.

6. The pipe flashing protector for protecting the joint between the vent pipe and roof flashing of claim 1 wherein the upper and lower shelf surface of the flange is of a greater length than the wall thickness of the upper and lower vent pipes.

7. The pipe flashing protector for protecting the joint between the vent pipe and roof flashing of claim 1 wherein the tubular portion has an interior surface that provides a frictional fit between the upper and lower vent pipe and the pipe flashing protector.

8. A method of protecting a joint between a vent pipe and roof flashing comprising the steps of:

forming a pipe flashing protector having a base portion, a conic portion extending up from the base portion and a tubular portion having a flange with an upper and lower shelf surface and extending through the sloped conic portion; and wherein a lower vent pipe is affixed to the lower shelf surface of the flange and an upper vent pipe is affixed to the upper shelf surface of the flange.

9. The method of protecting the joint between the vent pipe and roof flashing of claim 8 further comprising the step of dimensioning the pipe flashing protector to cover the joint protecting it from decay and debris.

10. The method of protecting the joint between the vent pipe and roof flashing of claim 8 further comprising the step of forming threaded connectors on a surface of the tubular portion for attachment of a threaded lower vent pipe and a threaded upper vent pipe.

11. The method of protecting the joint between the vent pipe and roof flashing of claim 8 further comprising the step of angling the base portion to match the slope of a roof.

12. The method of protecting the joint between the vent pipe and roof flashing of claim 8 further comprising the steps of:

cutting a vent pipe to a length matching the length from the base portion to the lower shelf of the flange;

inserting a cut off portion of the vent pipe through the tubular portion; and affixing the cut off portion of the vent pipe to the upper shelf surface.

13. The method of protecting the joint between the vent pipe and roof flashing of claim 8 further comprising the step of forming the upper and lower shelf surface of the flange to a length greater than the wall thickness of the upper and lower vent pipes.

14. The method of protecting the joint between the vent pipe and roof flashing of claim 8 further comprising the step of dimensioning the tubular portion to provide a frictional fit between the upper and lower vent pipe and the pipe flashing protector.

* * * * *